United States Patent [19]

Mateja

[11] Patent Number: 4,575,279

[45] Date of Patent: Mar. 11, 1986

[54] APPARATUS FOR SPREADING LIQUID MATERIAL

[76] Inventor: Edwin S. Mateja, 6028 S. Kolmar Ave., Chicago, Ill. 60629

[21] Appl. No.: 634,586

[22] Filed: Jul. 26, 1984

[51] Int. Cl.[4] ..... E01C 19/16

[52] U.S. Cl. ..... 404/111; 251/339; 252/501

[58] Field of Search ..... 404/101, 103, 107, 108, 404/110, 111; 222/501, 508, 608; 239/286, 302; 251/237, 293, 294, 339; 137/899, DIG. 2

[56] References Cited

U.S. PATENT DOCUMENTS

| | | | |
|---|---|---|---|
| 1,506,577 | 8/1924 | George | 251/339 X |
| 1,643,370 | 9/1927 | Brannen | 251/237 |
| 1,750,104 | 3/1930 | Heltzel | 404/107 |
| 2,197,878 | 4/1940 | Robinson | 404/103 |
| 2,956,486 | 10/1960 | Siegle | 404/111 X |
| 3,183,803 | 5/1965 | Gierhart | 404/111 |
| 3,519,169 | 7/1970 | Holland | 404/110 X |
| 3,841,779 | 10/1974 | Ray | 404/111 |
| 3,989,403 | 11/1976 | Verive | 404/111 |

*Primary Examiner*—Stephen J. Novosad
*Assistant Examiner*—John F. Letchford
*Attorney, Agent, or Firm*—Richard W. Carpenter

[57] ABSTRACT

A device for dispensing and spreading liquid material which includes a container mounted on a movable frame having a dispensing opening and valve assembly in the container and having roller and squeegee means mounted under the container for spreading the material after it has been dispensed.

1 Claim, 5 Drawing Figures

APPARATUS FOR SPREADING LIQUID MATERIAL

BACKGROUND OF THE INVENTION

1. Field of the Invention

This invention relates generally to material spreading devices, and more particularly to a device for spreading liquid material, such as a sealant, on a horizontal surface.

2. Description of the Prior Art

A prior art search directed to the subject matter of this application in the United States Patent and Tademark Office disclosed the following U.S. Pat. Nos. 791,726; 958,434; 1,173,620; 1,419,537; 1,641,703; 1,712,549; 1,811,324; 1,940,898; 2,615,693; 2,842,036; 2,956,486; 3,015,837; 3,031,166; 3,183,803; 3,283,675; 3,698,293; 3,841,779; 3,989,403.

None of the prior art patents uncovered in the search disclosed a liquid material spreading device including a frame supported on a wheel and axle assembly, a container having an aperture in a lower bottom wall, a control arm attached to the container, a valve assembly including a ball valve for opening and closing the opening in the bottom of the container, a valve operating mechanism mounted on the control arm for controlling the valve, and material spreading means which includes both a roller and squeegee positioned adjacent the opening in the container.

SUMMARY OF THE INVENTION

This invention relates to spreading and more particularly to a device for spreading viscous liquid material such as tar or other sealant on a horizontal surface.

It is the primary object of the invention to provide a device which can be used to both dispense and spread in a uniform manner liquid material from a container. A more specific object of the invention is the provision of a device including a movable container supported on a wheel and axle assembly and having a squeegee and a roller positioned under the container near the dispensing opening through which the material is distributed from the container to the surface to be covered.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
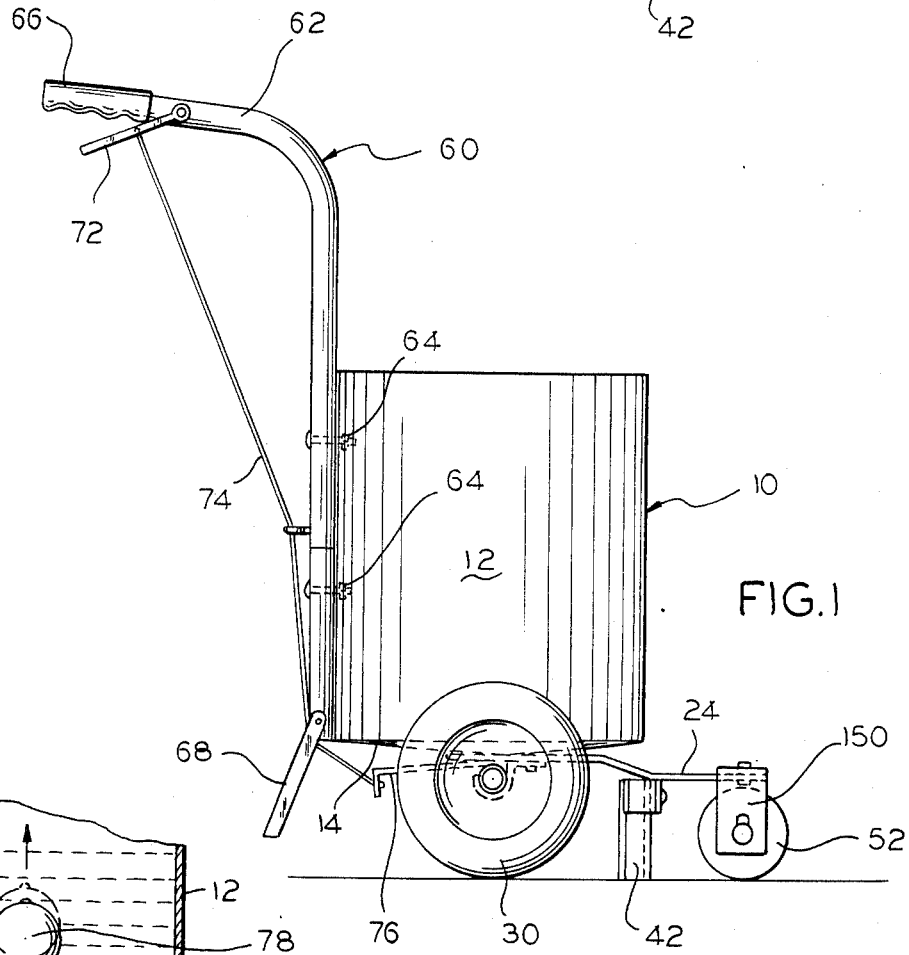
FIG. 1 is a side elevational view of a material spreading device embodying features of the invention.
Figure 3:
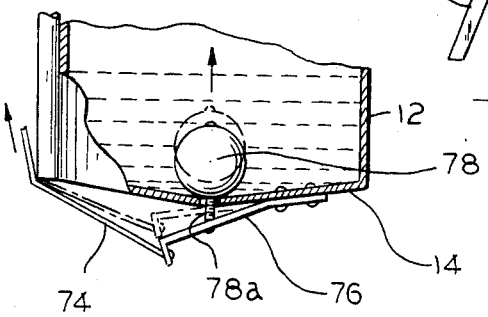
FIG. 3 is a fragmentary vertical sectional view of a portion of the structure illustrated in FIG. 1.
Figure 4:
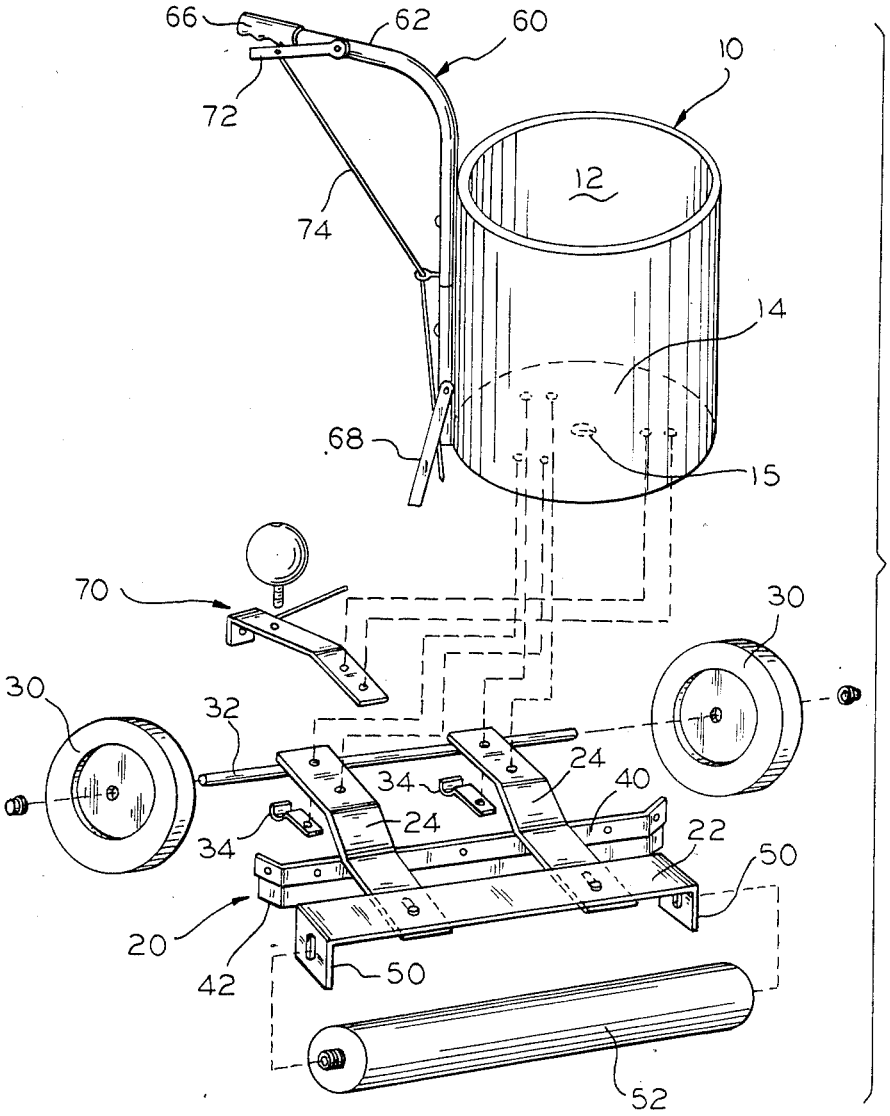
FIG. 4 is an exploded perspective view of the structure illustrated in FIG. 1.

Referring now to the drawings for a better understanding of the invention, and particularly to FIGS. 1 and 4, it will be seen that the unique device includes a preferably cylindrical container, indicated generally at 10, for holding the material to be spread. The container is supported on a frame indicated generally at 20 which is mounted on wheels 30 in a manner hereinafter described and which may be moved about by means of a control arm indicated generally at 60.

As best seen in FIG. 4 container 10 is preferably cylindrical in shape and includes a side wall 12 with an integral inverted somewhat conically shaped bottom wall 14 having an opening 15 extending through the central portion thereof. Passage of material through opening 15 is controlled by a valve assembly indicated generally at 70 which is described later in the specification.

Figure 2:
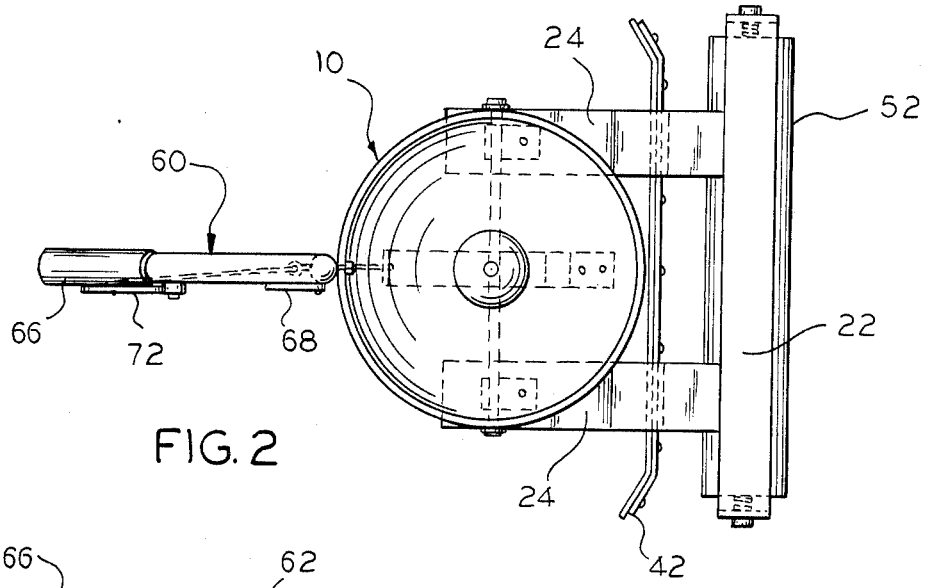
FIG. 2 is a top plan view of the structure illustrated in FIG. 1.

As best seen in FIGS. 2 and 4 the frame, indicated generally at 20, includes at least one transverse member 22 and a pair of longitudinal members 24 secured to each other in any desired manner such as by bolting or riveting.

The frame is supported on a wheel and axle assembly which includes a pair of wheels 30, mounted on opposite ends of an axle 32 which is attached to the underside of frame members 24 by means of brackets 34. Also mounted on the underside of longitudinal member 24 of frame 20 is a bracket 40 carrying a transversely extending flexible doctor blade or squeege 42.

Extending downwardly from the ends of frame transverse member 22 are a pair of brackets 50 which support a roller 52. The purpose of this squeegee and roller will be described later in the application.

As best seen in FIG. 4, control arm 60 is generally L-shaped with an upward rearwardly extending handle portion 62. The main portion of the control arm 60 may be secured to the side wall of the container by means of bolts or rivets 64 or in any other appropriate manner.

At its end handle 62 may be provided with a grip 66 to assist in moving the device. At the lower end of control arm 60 there may be provided a kick stand 68 pivotally connected thereto and operable to maintain the device in its level position when in use.

As best seen in FIG. 1 there is pivotally mounted on the handle portion of control arm 60 a lever handle 72 which is attached by means of a cable 74 to one end of a valve lever 76 the other end of which is connected to the lower portion of container 10.

The valve lever 76 is connected by means of stem **78*a* to a ball valve 78 which is positioned within the container itself, with the stem 78*a* extending through the opening 15** in the lower portion of the container.

Thus, in order to dispense liquid from the container, the handle lever 72 is moved upwardly causing a rearward end of valve lever 76 to move upwardly carrying with it the stem and the ball valve 78 so as to permit liquid material to pass through opening 15 and out of container 10. As the device is moved backward and forward the material is spread by means of roller 52 and squeegee 42.

Figure 5:
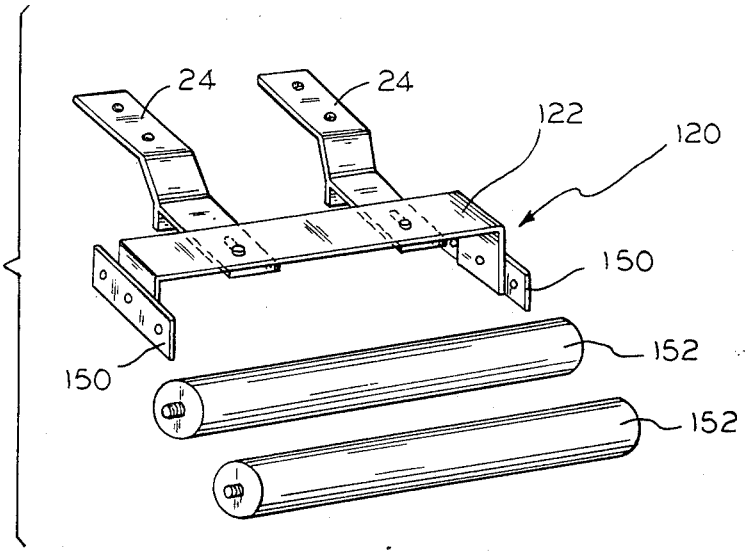
FIG. 5 is a view similar to a portion of the structure illustrated in FIG. 4 but showing a slightly modified form of the invention.

Turning now to FIG. 5, it will be seen that a slightly modified form of the invention is shown. In this embodiment the frame indicated generally at 120 includes a transverse member 122 having at the ends thereof brackets 150 which are adapted to hold a pair of rollers 152 mounted in tandem for cooperation with each other in spreading material dispensed from the container. The operation of this embodiment is the same as that of the previous embodiment.

Thus, it will be seen that the invention provides a unique and novel means of dispensing and spreading material in a convenient and efficient manner.

What is claimed is:

1. In a device for dispensing and spreading a flowable material, the combination of:

(a) a frame including at least one longitudinal member and at least one transverse member secured to each other;

(b) a wheel and axle assembly attached to said frame and movably supporting said frame;

(c) a container mounted on and carried by said frame, including a concave bottom wall having a lower portion with a material dispensing aperture extending therethrough;

(d) a generally L-shaped control arm including a vertical portion attached to said container and an integral horizontal handle portion extending rearwardly from said vertical portion;

(e) a ball type valve assembly for opening and closing the the aperture in said container to dispense material therefrom, said valve assembly including:

(i) a spherical stopper element positioned within said container adjacent said aperture;

(ii) a valve lever having one end attached to the underside of said container;

(iii) a stem element disposed to extend through said container aperture with its upper end secured to said spherical stopper element and its lower end secured to said valve lever;

(f) a valve operating mechanism attached to said valve assembly for operating same, said operating mechanism including:

(i) a handle lever pivotally mounted on said horizontal handle portion of said control arm;

(ii) a flexible line connecting said handle lever to said valve lever;

(g) material spreader means carried by said frame, including:

(i) at least one transversely disposed roller carried by said frame forwardly of said container dispensing aperture;

(ii) at least one transversely disposed squeegee carried by said frame between said aperture and said roller.

* * * * *